US009739084B2

(12) United States Patent
Brooks, III

(10) Patent No.: US 9,739,084 B2
(45) Date of Patent: Aug. 22, 2017

(54) WINDOW/DOOR INSTALLATION PRODUCT AND METHOD OF USE

(71) Applicant: John F. Brooks, III, Fairmount City, PA (US)

(72) Inventor: John F. Brooks, III, Fairmount City, PA (US)

( * ) Notice: Subject to any disclaimer, the term of this patent is extended or adjusted under 35 U.S.C. 154(b) by 0 days.

(21) Appl. No.: 14/719,251

(22) Filed: May 21, 2015

(65) Prior Publication Data

US 2015/0354208 A1 Dec. 10, 2015

Related U.S. Application Data

(60) Provisional application No. 62/002,781, filed on May 23, 2014.

(51) Int. Cl.

| | |
|---|---|
| ***E06B 1/52*** | (2006.01) |
| ***E06B 1/60*** | (2006.01) |
| ***E06B 1/02*** | (2006.01) |
| ***E06B 1/58*** | (2006.01) |

(52) U.S. Cl.

CPC ..... *E06B 1/6038* (2013.01); *E06B 1/02* (2013.01); *E06B 1/58* (2013.01)

(58) Field of Classification Search

CPC .. E04B 1/7641; E04B 2001/7679; E06B 1/02; E06B 1/32; E06B 1/6038; E06B 1/58

USPC ..... 52/204.1, 204.53, 204.55

See application file for complete search history.

(56) References Cited

U.S. PATENT DOCUMENTS

| | | | | |
|---|---|---|---|---|
| 4,030,258 | A * | 6/1977 | Anders | E05G 7/002 109/10 |
| 4,430,831 | A * | 2/1984 | Kemp | E06B 1/32 249/39 |
| 4,631,866 | A * | 12/1986 | Otto | E06B 1/32 292/341.19 |
| 6,442,912 | B1 * | 9/2002 | Phillips | C04B 41/4884 428/304.4 |
| 6,481,170 | B1 * | 11/2002 | Savenok | E04B 1/7629 264/45.1 |
| 8,109,052 | B2 * | 2/2012 | Rosende | E06B 1/6015 52/204.53 |
| 9,140,051 | B1 * | 9/2015 | Kierecki | E06B 7/14 |
| 2009/0056246 | A1 * | 3/2009 | Prince | E06B 3/56 52/204.53 |
| 2009/0205272 | A1 * | 8/2009 | Rosende | E06B 1/02 52/215 |
| 2010/0139187 | A1 * | 6/2010 | Medina | E06B 1/12 52/204.1 |
| 2011/0214370 | A1 * | 9/2011 | Stewart | E06B 1/32 52/215 |
| 2015/0211285 | A1 * | 7/2015 | Deiss | E06B 1/36 52/210 |

* cited by examiner

*Primary Examiner* — Paola Agudelo
(74) *Attorney, Agent, or Firm* — Gary P. Topolosky

(57) ABSTRACT

A rigid insert for using as an intermediate insulation component when installing a new or replacement window or door. The insert comprises an integrally formed, L-shaped section with: (i) a thin leg component designed for positioning against a long edge of the structural frame for this window or door; and (ii) a thick base component perpendicular to the thin leg component. The L-shaped section is glued to the structural frame and to adjoining sections at its mitered corners. A method for reducing thermal bridging with such inserts is also disclosed.

19 Claims, 7 Drawing Sheets

WINDOW/DOOR INSTALLATION PRODUCT AND METHOD OF USE

CROSS-REFERENCE TO RELATED APPLICATIONS

This is a perfection of Provisional Application No. 62/002,781, filed on May 23, 2014, the disclosure of which is fully incorporated by reference herein.

BACKGROUND OF THE INVENTION

When building energy efficient buildings, there are three main areas to address to make your building perform better:

First is to stop "thermal bridging" caused by a lack of insulation. Heat energy transfers through wood framing members thus making a wall system very inefficient.

Second is air tightness. When a building is not airtight, incoming drafts bring in undesired temperatures with airflow. This undesired airflow can also bring in unhealthy air while traveling by or through wall areas that have been subject to moisture issues.

Third is water management, both as to shedding bulk water and letting trapped moisture escape.

The use of exterior insulation is a great and cost effective way to handle all three of foregoing items when done properly. There is a weak point with rigid insulation at the openings of windows and doors, however. General practices teach to build one's access (i.e., window or door) openings wider than the rough opening. The window/door can then be framed out with wider lumber to meet the additional depth of insulation at the attachment points for these windows and doors. While doing a good job of making an anchor point for the access (windows and doors) areas, wood framing makes for a very week point for insulation. Such points are called thermal bridges. At these thermal bridge points, cool air escapes through conduction in the summer while also letting cold air into your house in the winter.

At these same thermal bridge points, there is often a moisture management problem. See especially FIG. 1—PRIOR ART. Wood (or lumber) frame surrounds become a dew collection point causing unwanted condensation. That condensation accrues on the outside of a structure in the summer for promoting fungus, mold, mildew, and rot. In the winter, moisture problems often occur inside the structure. In addition, condensations like these contribute to airborne contaminants that the structure occupants breathe.

Known insulation systems include, but are not limited to: the releasable/re-attachable window frame insulation system of Sahadeo et al. U.S. Pat. No. 8,479,462; the "adhearable" window insulation material of Shippen U.S. Pat. No. 5,108,811; the gasket driven window insulation approach of Ahonen U.S. Pat. No. 4,624,077; and Bauch's Removable Insulation System per U.S. Pat. No. 4,486,990. Internationally, there is also known the thermal insulation window structure of Foster Canadian Patent No. 1,275,200 and WIPO No. 2014/033,231 to Soudal.

SUMMARY OF THE INVENTION

The primary advantages of this invention include:

1. Stopping thermal bridging at window and door opening (no condensation point for mold or mildew growth)
2. Providing an improved building envelope of insulation at the mounting point of new or replacement windows and doors saving the homeowner on monthly utilities
3. Helping to provide a more complete drainage plane 4. Making an access (window or door) surround vapor permeable to let trapped moister escape in a vapor form thereby minimizing the likelihood of any mold or mildew sites
5. Providing a solid one piece insulation design that will keep a strong air seal at these critical window and door points Such advantages are accomplished with:

SUMMARY OF THE DRAWINGS/PHOTOGRAPH

Further features, objectives and advantages of this invention will become clearer when referring to the detailed description and claims made with reference to the accompanying visuals in which:

DETAILED DESCRIPTION OF PREFERRED EMBODIMENTS

Figure 1:
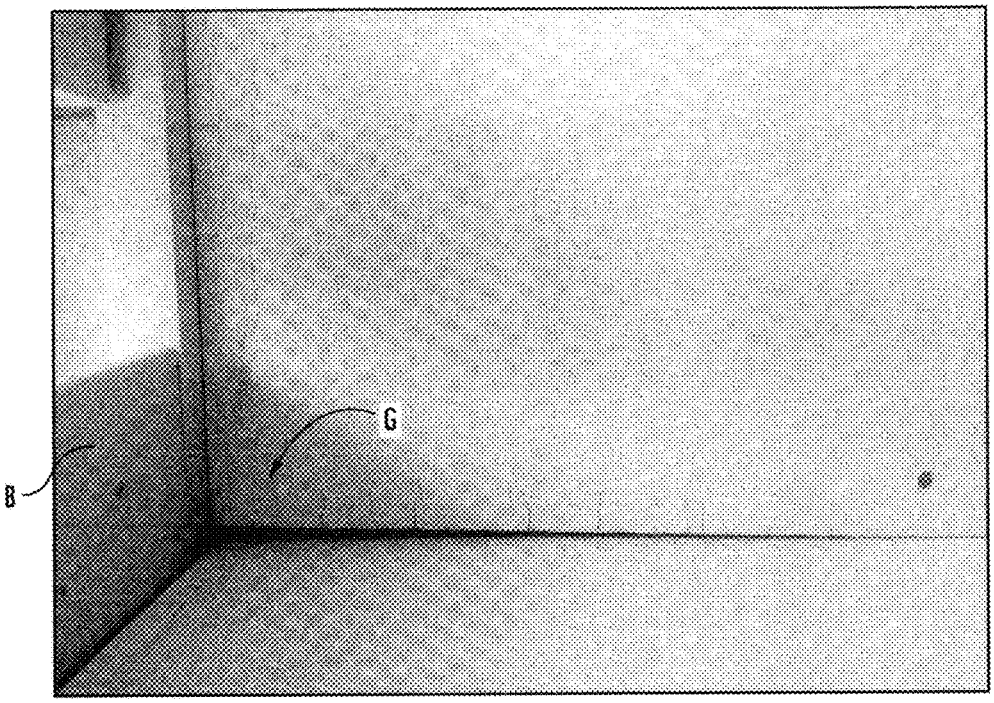
FIG. 1 PRIOR ART
FIG. 1 shows some standard PRIOR ART window installation issues, including air gapping and (with time) the proliferation of mold growth at or near moisture accumulation areas, items that this invention aims to correct and/or eliminate.
Figure 2:
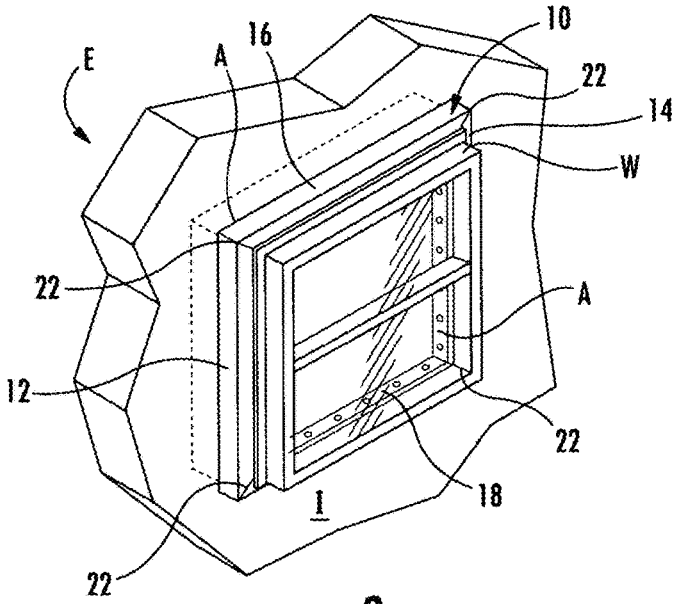
FIG. 2 is an exterior perspective view showing a window installed using one embodiment of the present invention about the four sides (perimeter) of the duly installed window.
Figure 3:
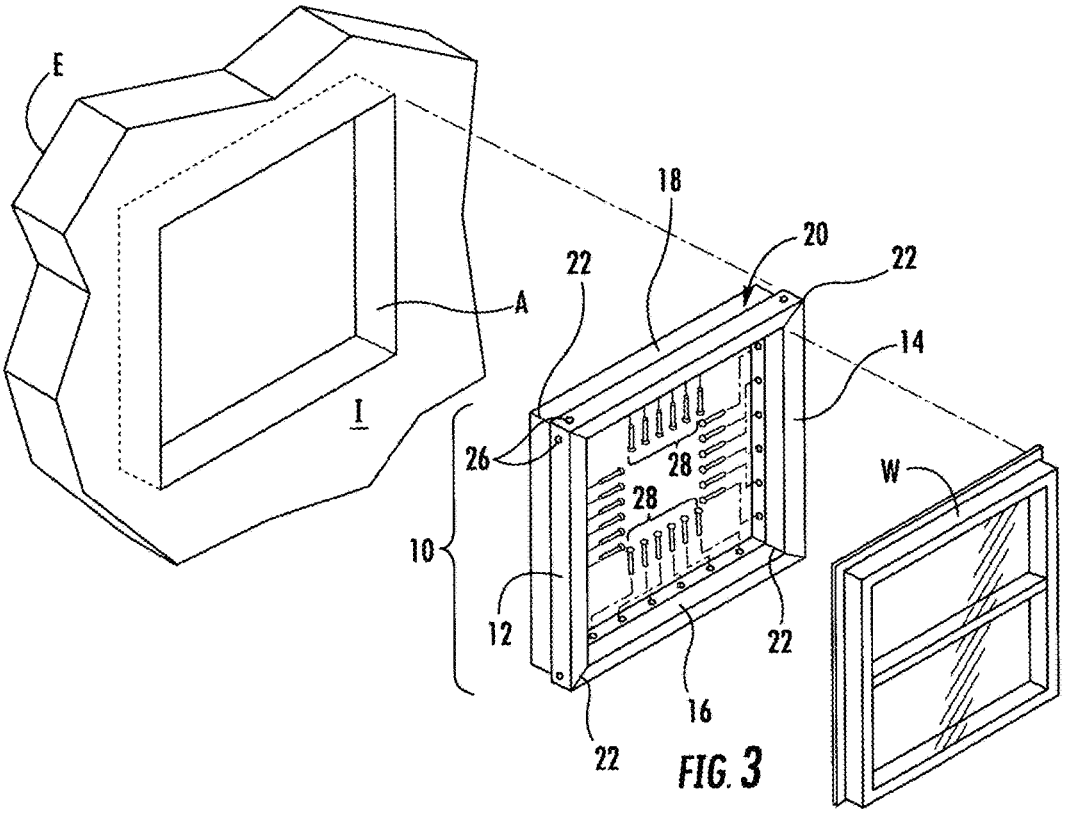
FIG. 3 is an exploded exterior view of the window and invention from FIG. 2.
Figure 4A:
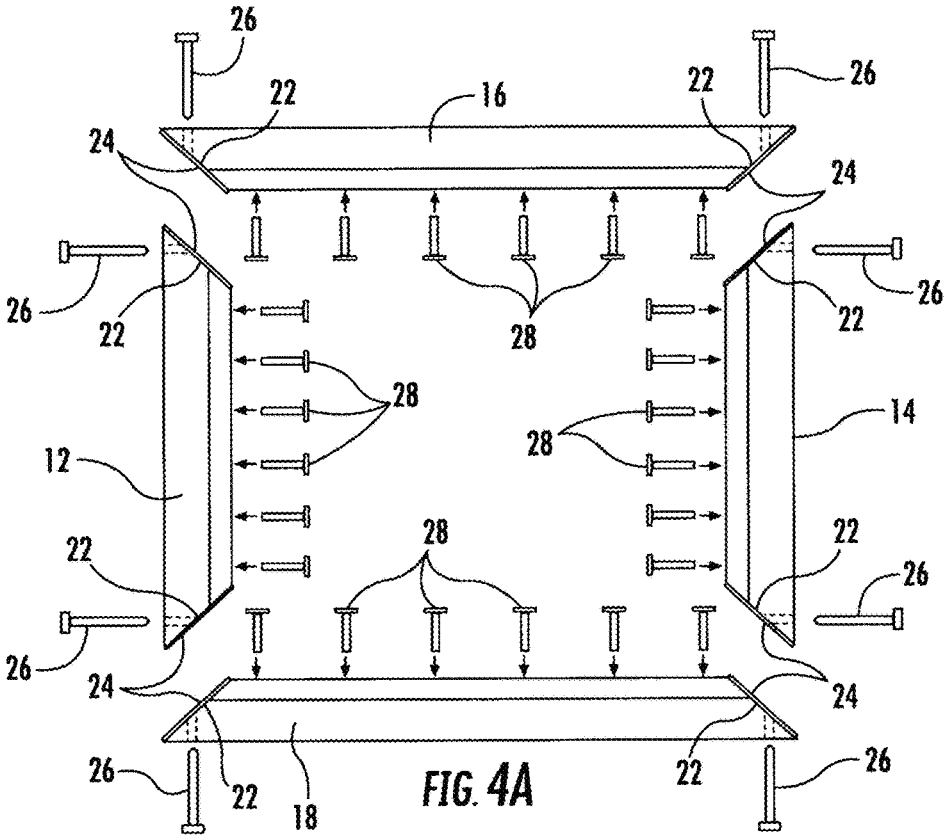
FIG. 4A is a front plan view showing four sections of insulation segments as would be glued at the beveled corner cuts and nailed about the access (window) opening of an installation point.
Figure 4B:
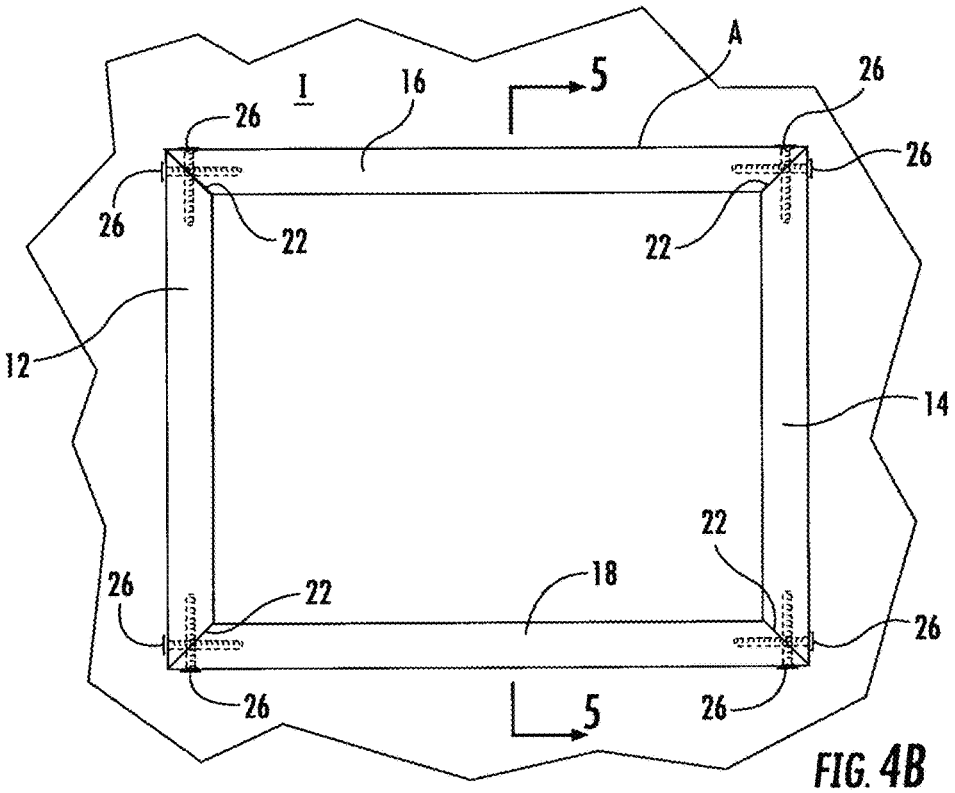
FIG. 4B is a front plan view of the FIG. 4A sections joined and then nailed together at their respective corner junctures in an exterior wall view.
Figure 5:
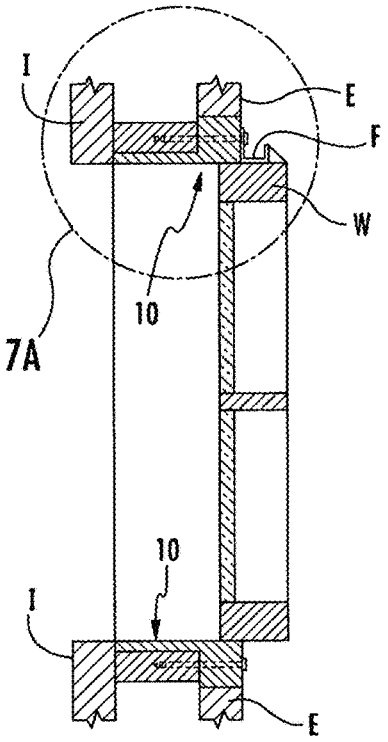
FIG. 5 is a sectional view of the insulation sections of FIG. 4B, taken along lines 5-5 of FIG. 4B, with a representative window added for fuller illustration purposes.

Prior to this invention, there were two known construction methods for mounting windows and doors with exterior insulation. The first and more commonly used method includes building a wooden frame (window or door) buck. This buck, typically made from dimensional lumber, forms a box shaped extension around (or inside of) the window/door rough opening to match the thickness of the exterior insulation being used. While this works for supporting the loads placed on the windows and doors, it fails in several other areas: first, dimensional lumber is not stable. It will shrink and warp causing issues where window flashing is installed, letting bulk water and air enter through these areas. Second, wood/lumber has a very minimal R-value, R1 per inch. So it conducts heat energy rather easily. This not only encourages energy loss, it also causes condensation to occur and the structural and health issues associated therewith. Third, in the winter months, the condensation that occurs inside the structure leads to mildew and mold. And when the moisture content of wooden frame members is raised, the structural members are more prone to rot. Finally, during the warmer months, cool temperature from inside the building conducts through the wooden framing causing condensation to occur outside of the wall. And some types of structural insulation won't let this water "escape" further proliferating the aforementioned issues.

The second known means installs windows and doors directly over the exterior insulation being used. While this may insulate the mounting areas, it causes other problematic issues. For instance, typical exterior insulation is not made to withstand the weight of some windows. That insulation will permanently compress over time causing air and moisture leakage and possible damage to the window itself. Insulation compression also results from the wind loads forces placed on these structural accesses (windows and doors) leading to additional leakage concerns. The installation of windows and doors over insulation sheeting may also void window and door manufacturers warranties due to these issues. If condensation or bulk water gets behind the insulation, it can easily migrate into the structure at the rough openings causing mold, mildew and structural rot.

The mounting of windows and doors in conjunction with exterior insulation has become such an issue that the FMA (Fenestration Manufactures Association)/AAMA (American Architectural Manufactures Association)/WDMA (Window and Door Manufactures Association) have formed an installation steering committee. That committee is working hard to develop new ways to properly install windows and doors with exterior insulation. They are calling the targeted improvement a "ROESE", the acronym for a ROUGH OPENING EXTENSION SUPPORT ELEMENT. The committee defines this ROESE as a projection ("bump-out") or extension to the structural wall framing at the rough opening perimeter. The function of the ROESE is to: (i) support the weight of the window, (ii) allow direct structural attachment of the window to transfer wind loads to the structure, and (iii) enable window alignment with the exterior plane of the FPIS (foam plastic insulation sheeting) for proper integration with cladding and/or water resistive barrier (or WRB). A suitable ROESE shall consist of a material and fastening method that can maintain a structural continuity between the surrounding framing and window.

This invention will improve the overall installation of windows and doors, both new and replacement. When used in conjunction with exterior insulation, these products will serve as a "bump out" or extension from the structural wall that will support and insulate while also acting as viable air barriers and bulk water shed points. These specially made and shaped sections of insulative material (uncoated, partially coated, or fully coated) will function to insulate the mounting areas of windows and doors thus minimizing (or even fully stopping) thermal energy loss. These pieces of L-shaped material will also better support the weight of the structural access (window or door) and further transfer wind loads to the structure. These insulation pieces get their strength from their size and shape as well as the materials used to construct them.

The individual pieces are direct molded or precision cut to fit the rough opening of a window or door surround with all joints being glued thereabout for giving the invention added strength and improved abilities to seal out liquid water. For a new construction, these pieces are installed before the window or door and the adjacent exterior insulation. The window or door is then mounted through the insulating pieces and to its structural framing members.

Figure 6A:
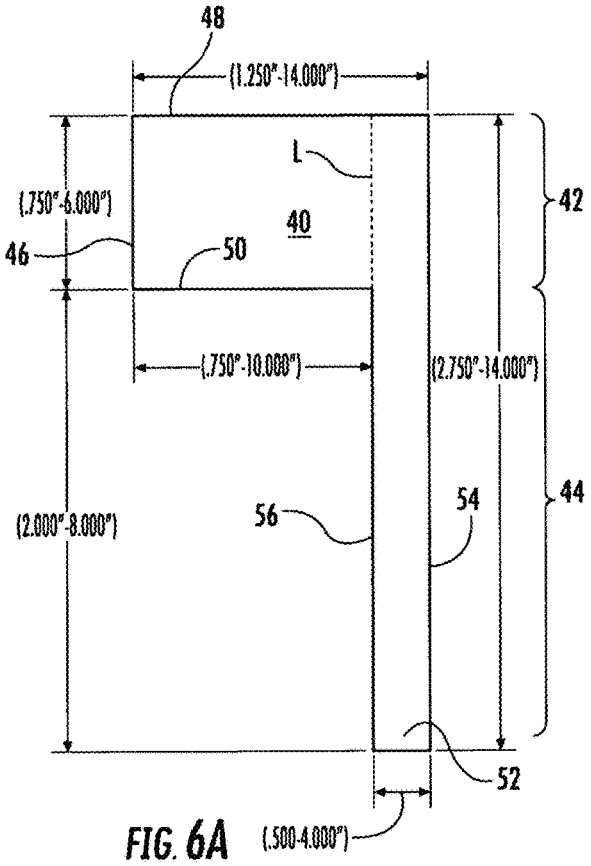
FIG. 6A is an axial (or longitudinal) side view of one shape of window/door frame installation according to this invention, said shape being mechanically cut or molded/preformed to its preferred cross-sectional "L shape" with each dimension of this preferred shape showing its range of acceptable relative sizes.

As best shown in the dimensional ranges of accompanying FIG. 6A, the insulation pieces of this invention come in different sizes for better matching with the thicknesses of exterior insulation used on the building/structure. The reason for such coordinated matching is to better align the window or door with the exterior plane of that insulation. Such orientation makes the installation of window/door flashing easier and more effective. It also creates a better alignment for the installation of exterior cladding. When installed correctly, these pieces will seal bulk water from getting behind thus saving several flashing steps otherwise needed with wooden window buck installations.

Figure 8A:
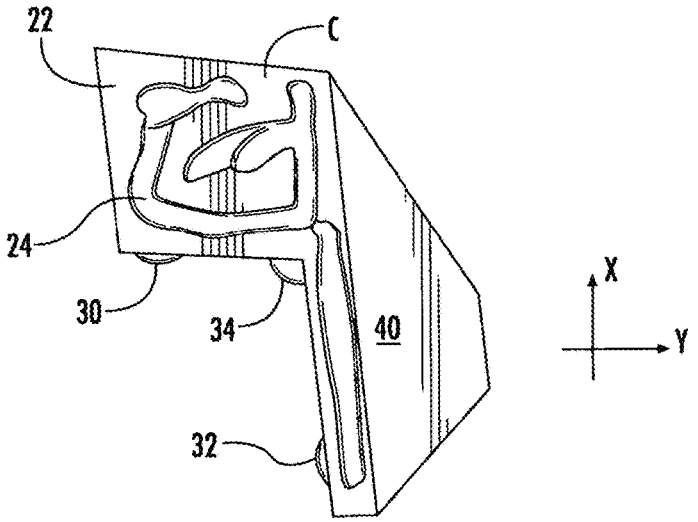
FIG. 8A is a perspective close up view showing a representative insulation piece per this invention with beads of glue applied at both the joining beveled corner and axially along wood opening contacting surfaces of this insulation piece.

Referring to FIG. 8A, each individual piece of insulation for this invention is preferably glued along multiple axes, where they contact with the window/door frame surrounds (i.e., axis Y, so as to not allow any one piece to be pulled away from the structure) and along axis X, where each piece further secures to the structural wall compounding its strength to support extreme loads. In addition, it is preferred that adjoining pieces be further glued to one another at their respective, mitered corners (plane C in FIG. 8A). It should be noted that the rough access opening will need to be made larger to accommodate the installation at axis X inside of the rough opening. In addition, when axis Y is properly glued into place, that glue "joint" will further assist in sealing out liquid water and making the overall construction more leak-proof.

Representative materials for making the pieces of this invention include a rigid composition such as an expanded polystyrene (EPS), Neopor® as made and sold by BASF, an extruded polystyrene (XPS), a polyurethane, a polyisocyanurate, a compressed mineral wool, and a rigid fiberglass compound. Pieces made from the foregoing materials will stop thermal bridging at the structural envelope openings for both doors and windows. The pieces themselves should be the same thickness on the outside as that of the exterior rigid insulation before reducing in thickness where the piece will protrude through the wall assembly and into the structure's interior.

By making the thin "fin" that protrudes through the access opening, the invention makes the entire surround system stronger, more durable and more water resistant. These thin fins are glued and then further nailed (or screwed) in place compounding their overall strength of assembly. With an integrally formed unit, each piece/fin will be more air tight especially when glued at adjoining, mitered corners. When more preferably made from EPS or Neopor®, the pieces of this invention also become vapor permeable, thus allowing them to shed bulk water while letting trapped moisture escape trouble areas in the form of moisture vapor.

Designed for optimal water management for all four real-life water management concerns, bulk water, vapor permeability, water absorption, and water release, this invention saves energy for heating and cooling, while further supporting sustainable building practices.

The uniqueness of making these pieces in a preferred shape (and size) from certain rigid insulating foams addresses numerous environmental concerns and the rising energy costs that are driving local codes to adopt more energy efficient practices for new residential and commercial buildings. The rigid insulation that this invention provides does a great job of stopping thermal bridging and minimizing (or even eliminating) water leakage concerns around the access (window and door) frames proper.

In the accompanying drawings, elements common to alternative embodiments are commonly numbered though in the next hundred series. Now referring to FIG. 1, there is shown a wood framed window buck in an extremely airtight house. Arrow B therein points to mildew growth escaping from the jointed area of the window trim and window. Element G shows the trim warping and cracking due to moisture condensation issues that happening in the winter time through this wooden window buck. This invention aims to eliminate such window gapping problems.

In accompanying FIGS. 2 through 5 and 7A, there is shown a first preferred embodiment of insulation insert (or piece/fin surround) according to this invention. Particularly, within a structural wall with its interior I and exterior E, there will be cut out (or otherwise framed) an aperture A into which a new (or replacement) window W will be installed using window-to-wall nails N.

Per the present invention, insertion of the window W into aperture A is first preceded by the installation of numerous sections of insulation inserts, generally 10. The combination of four such inserts, two vertical 12, 14 and two horizontal 16, 18, form their own pre-installation framing 20 as best seen as the middle component in the cutaway view at FIG. 3. At each mitered corner 22 of adjoining inserts, there is placed a dab of adhesive/glue 24 before adjoining, glued edges (properly cut to size) are further joined to one another with nails 26, preferably from both lateral sides. Screws (not shown) may be substituted for these nails or used to further supplement the same in some installations, especially those involving longer insert components (for wide and/or tall windows).

For best joining the framing 20 of inserts to its surrounding structural elements about aperture A, it is preferred that a plurality of nails 28 be used in and along each respective insert component, at an angle perpendicular to the direction of physical insert installation. As best seen in FIG. 8A, such nailing of inserts should only take place after each individual component has been first supplied with more adhesive/glue along their respective X and Y axes, the glue for axis X being element 30, axis Y, element 32 and an elongate line of glue being applied at where these two axes meet, corner gluing 34.

Once the framing 20 is properly positioned, and the window W secured there against, a final step would include securing strips of flashing F to the top and sides of the window for encouraging water redirection away from where the window otherwise meets with exterior wall E.

FIG. 6A shows preferred dimensional ranges for one such piece of insulation insert according to this invention. Particularly, that generally L-shaped insert 40 consists of a thicker base component 42 and thinner leg component 44 with the caveat that these two parts are NOT made from two rectangular sections glued together along imaginary line L in FIG. 6A, but rather molded and/or machine cut from a single, unitary piece of preferred insulation material so as to NOT be vulnerable to water and/or air leakage along a glued line L equivalent. Nevertheless, the two subcomponents making up insert 40 have preferred ranges of thickness. For instance, the short edge 46 to base component 42 can range in sizes from about 0.75 inch up to about 6 total inches thick. Its adjoining long edge 48, at the top of the view shown in FIG. 6A can range from about 1.25 inch up to about 14 inches long (depending on the thickness of the structure's rigid insulation that will be situated next to the installed window proper—see FIG. 7A). Parallel to long edge 48 and extending along the other side of short edge 46 is the first corner face 50 to insert 40. The size of that first corner face can range from about 0.75 inch to as much as 10 inches in most cases.

For the other main subcomponent to insert 40, the thin leg component 44, there is its own short edge 52 which can range in size (i.e., thickness) from about 0.5 inch up to as much as 4 inches thick. The long edge 54 to thin leg component 44, by contrast, can range from about 2.75 inch up to about 14 total inches in length. And finally, for the thin leg component inner wall element that runs parallel to first corner face 50 of the thick base component 42, or second corner face 56, it can range in relative "length" from about 2 to as much as 8 inches long.

Figure 6B:
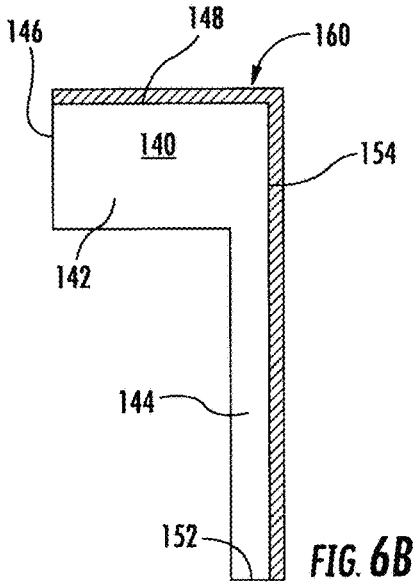
FIG. 6B is an axial (or longitudinal) side view of a first alternative embodiment of window/door frame insulation with a laminate added to two main, window wood-contacting sides/edges of this cross-sectional "L shape"
Figure 6C:
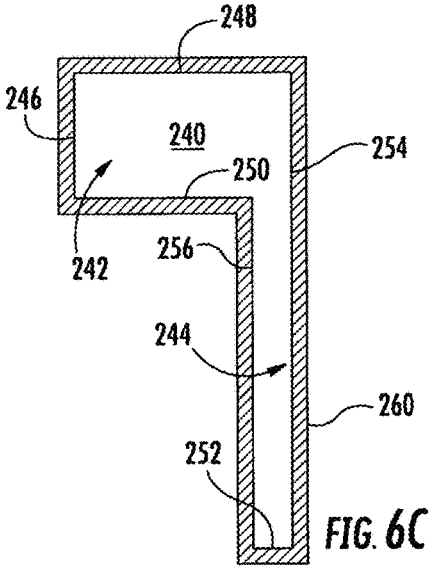
FIG. 6C is an axial (or longitudinal) side view of a second alternative embodiment of window/door frame insulation with a further moisture barrier spray coated all about the exterior surface of this cross-sectional "L shape"

FIGS. 6B and 6C show alternative embodiments to that primarily shown at FIG. 6A. In 6B, insert 140 has a layer of laminate 160 applied to both OUTER faces, or long edge 148 to base component 142 AND long edge 154 to thin leg component 144. This can be a separate element (also L-shaped) permanently affixed (via glue or fasteners) to the outer faces of insert 140 for enhanced structural rigidity and further improved water/air leakage resistance. Laminate layer 160 can also be roll-coated and/or spray applied to these two outer faces, base long edge 148 and thin leg long edge 154. This laminate can be either wood, plastic or metal based.

Figure 7A:
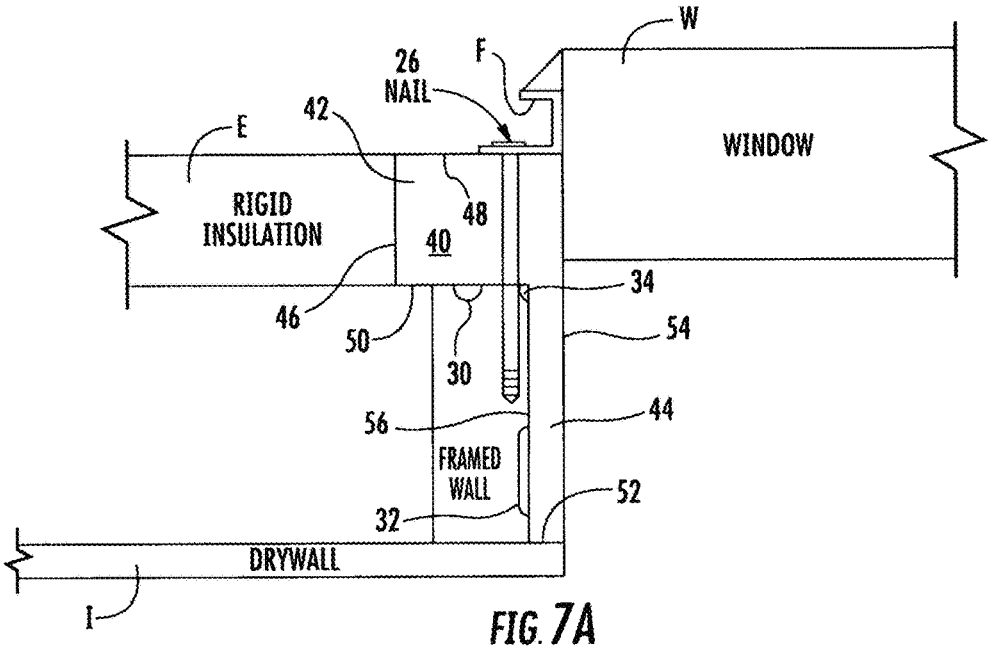
FIG. 7A is a side sectional view showing a typical window installation after incorporation of the insulation component of FIG. 6A with adjacent building components duly labeled, 7A representing an expanded, 90 degree rotated view of the circled area 7A in FIG. 5.
Figure 7B:
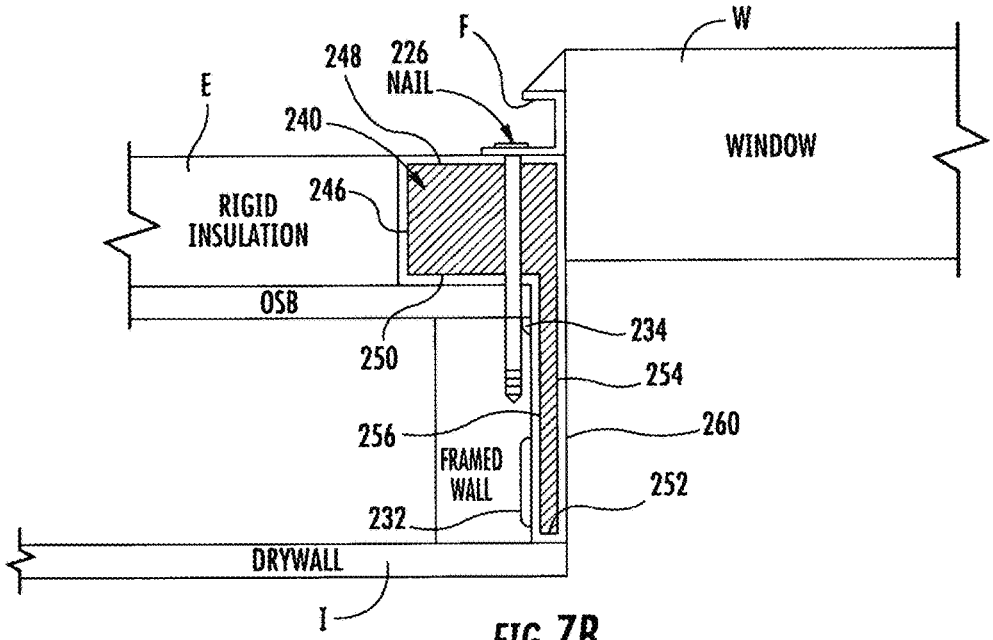
FIG. 7B is a side sectional view showing a typical window installation after incorporation of the insulation component of FIG. 6C with adjacent building components duly labeled.

In the second alternative embodiment of FIG. 6C, this concept of added strength, rigidity and improved "waterproofing" is taken further by applying a full coating 260, on all exterior sides, of insert 240. That would mean, most likely, spray coating all about the three respective edges to base component 242, namely short edge 246, long edge 248 and first corner face 250, as well as all three "sides" to thin leg component 244, or its short edge 252, long edge 254 and second corner face 256. Examples for coating layer 260 include a polyurea and/or a polyaspartic material. Note, that the alternate cross sectional view of elements at FIG. 7B shows the fully encased version of insert 240 from FIG. 6C. Also note the use of an oriented strand board (or OSB) therein. Some builders use plywood as a structural sheeting alternative to this OSB layer.

Figure 8B:
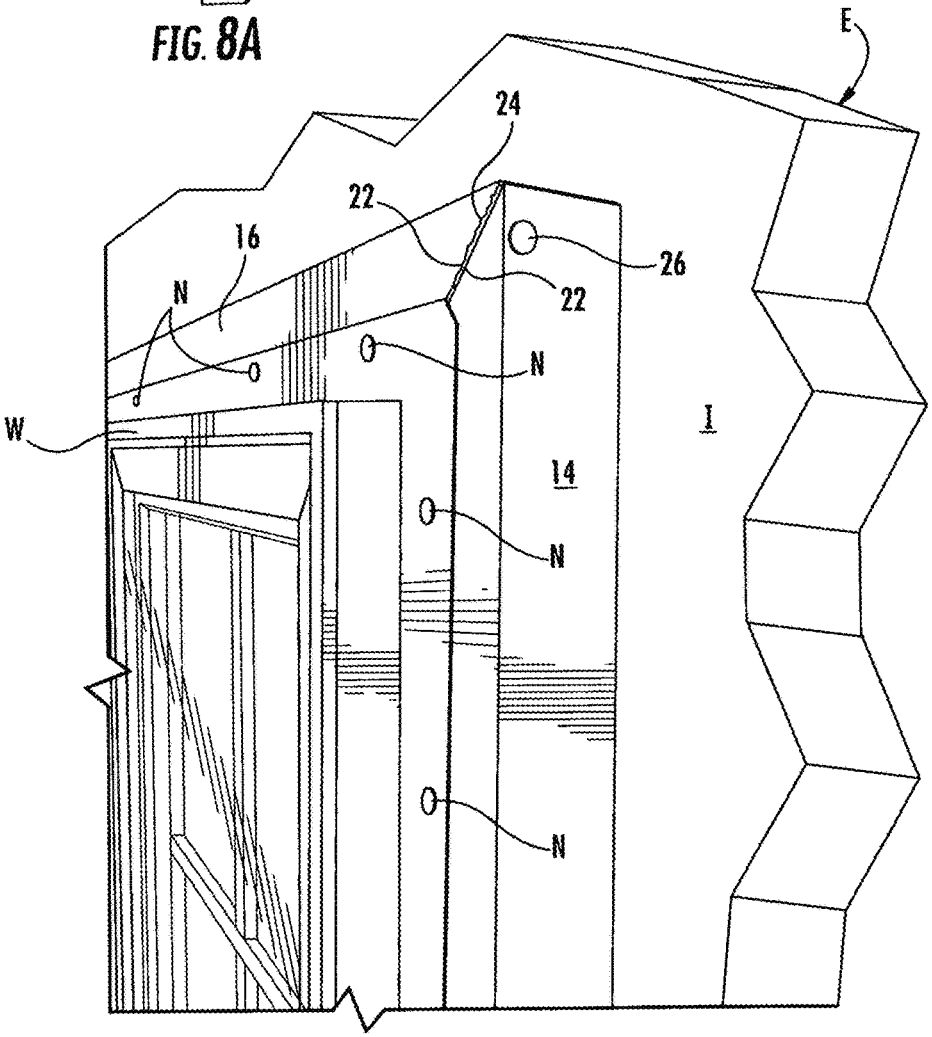
FIG. 8B is a perspective, exterior view showing corner joined sections of insulation per this invention and a newly installed window abutting same.
Figure 9:
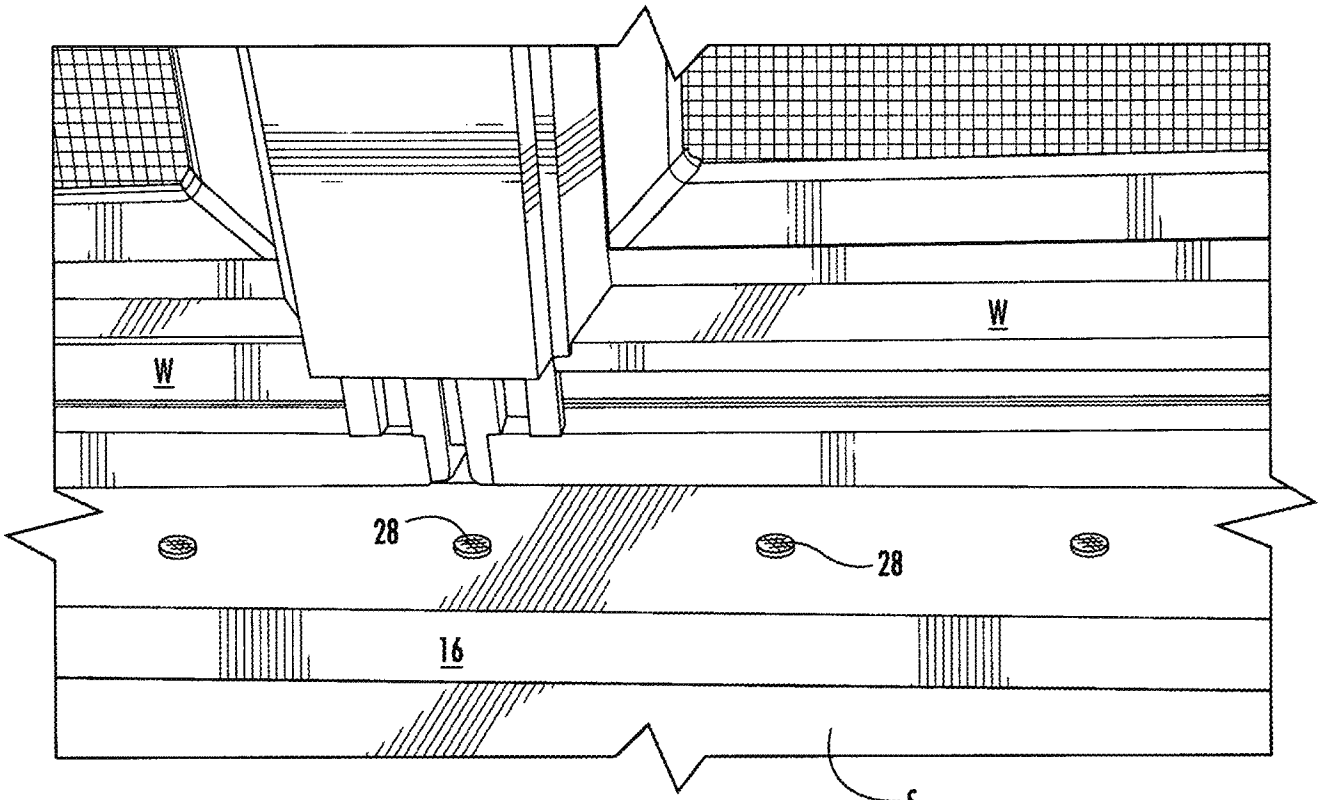
FIG. 9 is a perspective, close up interior view showing the insulation piece as nailed in place (after gluing) with the installed window bottom resting thereon.

FIG. 8B shows a close up view of one INSIDE corner of window installed about the inserts of the present invention, duly mitered and glued together at each corner (only one shown). FIG. 9 focuses on the lower inside ledge to a larger (dual window) installation for showing how the inserts 340 are nailed to the underlying window surround S before subsequent final window trim pieces (fancy moldings and the like) are applied thereabout.

While several modifications of the preferred form have been described above, it will be understood that still other variations and modifications can be made without departing from the spirit of the invention.

What is claimed is:

1. A system for a new or replacement window or door access to a structure, said window or door access being mounted into a framed opening in the structure, said system comprising:

(a) the framed opening in the structure for the new or replacement window or door access, said framed opening having along each side an outside face, an outside edge, an inside face, an inside edge and a substantially planar surface extending between the outside edge and the inside edge; and (b) an insert for installing against the outside face and the substantially planar surface of each side of the framed opening to serve as an insulation component when installing the new or replacement window or door access into the framed opening in the structure, said insert comprising: an L-shaped cross section with: (i) an elongated thin leg component having an interior surface designed for positioning against the substantially planar surface of the framed opening in the structure for the new or replacement window or door access; and (ii) a thick base component perpendicular to the elongated thin leg component, said thick base component sharing a planar surface with the elongated thin leg component and extending integrally therefrom, said shared planar surface extending at least partially into the framed opening in the structure, said thick base component having an interior surface designed for: (i) positioning against the outside face and the outside edge of the framed opening in the structure and (ii) extending substantially perpendicular to the substantially planar surface of the framed opening in the structure, said thick base component having an exterior surface designed for positioning against the new or replacement window or door when the new or replacement door is installed for reducing thermal bridging at the framed opening of the structure.

2. The system of claim 1 wherein the L-shaped cross section of the insert is installed by gluing, nailing or both gluing and nailing: (i) the interior surface of the elongated thin leg component to the substantially planar surface of the framed opening of the structure and; (ii) the interior surface of the thick base component to the outside face of the framed opening of the structure.

3. The system of claim 1 wherein four L-shaped cross sections of the insert are mitered at opposed ends, joined together at adjacent mitered ends and installed to the framed opening in the structure.

4. The system of claim 1 wherein the L-shaped cross section of the insert for a top of the framed opening in the structure for a new or replacement door access is mitered at opposed ends and the L-shaped cross section of the insert for each of two elongate sides of the framed opening in the structure for a new or replacement door access are both mitered at their uppermost ends closest to the L-shaped cross section of the insert for the top of the framed opening, joined together at adjacent mitered ends and installed to the framed opening in the structure for installing the new or replacement door directly against said L-shaped cross sections.

5. The system of claim 1 wherein the L-shaped cross section of the insert is cut from elongate lengths of a material selected from the group consisting of: an expanded polystyrene (EPS), an extruded polystyrene (XPS), a polyurethane, a polyisocyanurate, a compressed mineral wool and a rigid fiberglass.

6. The system of claim 1 wherein the L-shaped cross section of the insert is molded into elongate lengths from a material selected from the group consisting of: an expanded polystyrene (EPS), an extruded polystyrene (XPS), a polyurethane, a polyisocyanurate, a compressed mineral wool and rigid fiberglass insulation.

7. The system of claim 1 wherein the L-shaped cross section of the insert is further covered on at least two elongate sides with a water-resistant laminate sheet made from wood, plastic or metal.

8. The system of claim 1 wherein the L-shaped cross section of the insert is coated on at least two elongate sides with a water-resistant spray layer.

9. The system of claim 8 wherein the water-resistant spray layer of the insert consists essentially of a polyurea material, a polyaspartic material and combinations thereof.

10. A system for insulating around a framed opening in a structure before installing a new or replacement flanged window in the structure, said system comprising:

(a) the framed opening in the structure, each side of the framed opening having an outside face, an outside edge, an inside face, an inside edge and a substantially planar surface extending between the outside edge and the inside edge;

(b) a rigid insert for using as an insulation component for each side of the framed opening before installing the new or replacement flanged window into the framed opening in the structure, each rigid insert comprising: an integrally formed, L-shaped cross section with: (i) an elongated thin leg component having an interior surface designed for gluing, nailing or both gluing and nailing to the substantially planar surface of the framed opening in the structure for the new or replacement flanged window; and (ii) a thick base component perpendicular to the elongated thin leg component, said thick base component sharing a planar surface with the elongated thin leg component, said shared planar surface extending at least partially into the framed opening for the new or replacement flanged window, said thick base component having an interior surface designed for gluing, nailing or both gluing and nailing to the outside face of the framed opening in the structure for the new or replacement flanged window and having an exterior surface designed for installing the new or replacement flanged window therethrough and to the framed opening.

11. The system of claim 10 wherein each L-shaped cross section of the rigid insert is mitered at opposed ends, glued to adjacent mitered L-shaped cross sections and installed along adjacent sides of the framed opening for the new or replacement flanged window.

12. The system of claim 10 wherein each L-shaped cross section of the rigid insert is cut or molded from elongate lengths of a material selected from the group consisting of: an expanded polystyrene (EPS), an extruded polystyrene (XPS), a polyurethane, a polyisocyanurate, a compressed mineral wool and rigid fiberglass insulation.

13. The system of claim 12 wherein each L-shaped cross section of the rigid insert is integrally formed from an expanded polystyrene (EPS).

14. The system of claim 10 wherein each L-shaped cross section of the rigid insert is further covered on at least two elongate sides with a water-resistant laminate sheet.

15. The system of claim 10 wherein each L-shaped cross section of the insert is coated on at least two elongate sides with a water-resistant spray layer.

16. A system for insulating around a new or replacement flanged window being installed in a framed opening in a structure to reduce thermal bridging, said system comprising:

(a) the framed opening in the structure, each side of the framed opening having an outside face, an outside edge, an inside face, an inside edge and a substantially planar surface extending between the outside edge and the inside edge, and (b) a rigid insert for using as an insulation component for each side of the framed opening before installing the new or replacement flanged window into the framed opening in the structure, each rigid insert comprising: an integrally formed, L-shaped cross section with: (i) an elongated thin leg component having an interior surface designed for gluing, nailing or both gluing and nailing to the substantially planar surface of the framed opening in the structure for the new or replacement flanged window; and (ii) a thick base component perpendicular to the elongated thin leg component, said thick base component sharing a planar surface with the elongated thin leg component, said shared planar surface extending at least partially into the framed opening for the new or replacement flanged window, said thick base component having an interior surface designed for gluing, nailing or both gluing and nailing to the outside face of the framed opening in the structure for the new or replacement flanged window and said thick base component having an exterior surface designed for positioning against the framed opening when the new or replacement flanged window is installed through the exterior surface and to the framed opening, an outermost skin of said rigid insert being fully coated with a water-resistant spray layer.

17. The combination of claim 16 wherein the water-resistant spray layer of the rigid insert consists essentially of a polyurea material, a polyaspartic material and combinations thereof.

18. The combination of claim 16 wherein each L-shaped cross section of the rigid insert is cut or molded from elongate lengths of a material selected from the group consisting of: an expanded polystyrene (EPS), an extruded polystyrene (XPS), a polyurethane, a polyisocyanurate, a compressed mineral wool and rigid fiberglass insulation.

19. The combination of claim 18 wherein each L-shaped cross section of the rigid insert is integrally formed from an expanded polystyrene (EPS).

* * * * *